US005117734A

United States Patent [19]

Rhoads

[11] Patent Number: 5,117,734

[45] Date of Patent: Jun. 2, 1992

[54] RIFLE BORE COOLER

[76] Inventor: Richard A. Rhoads, R.D. 2, Box 407A, Bernville, Pa. 19506

[21] Appl. No.: 765,421

[22] Filed: Sep. 25, 1991

[51] Int. Cl.[5] ..... F41A 13/00; F41A 21/00

[52] U.S. Cl. ..... 89/14.1; 89/1.2

[58] Field of Search ..... 89/14.1, 1.2, 1.12, 89/30, 1.1; 98/2.11

[56] References Cited

U.S. PATENT DOCUMENTS 783,050 2/1905 Knapp et al. ..... 89/1.2
2,188,741 1/1940 Roberk ..... 98/72
2,273,839 2/1942 De Port et al. ..... 89/14.1
2,791,940 5/1957 Speake et al. ..... 89/1.2
4,463,653 8/1984 Pusch et al. ..... 89/14.1

*Primary Examiner*—David H. Brown
*Attorney, Agent, or Firm*—H. Jay Spiegel

[57] ABSTRACT

A rifle bore cooler is disclosed which is designed to be removably attachable to the end of a rifle barrel. The device includes a ventilating fan which may be battery powered and which may be selectively activated to either blow ambient air into the rifle bore or, alternatively, to pull hot air therefrom.

7 Claims, 1 Drawing Sheet

RIFLE BORE COOLER

BACKGROUND OF THE INVENTION

The present invention relates to a rifle bore cooler. In the prior art, it is known to provide a conduit with a ventilating fan to remove heat therefrom or supply ambient air thereto. In this regard U.S. Pat. Nos. 2,188,741 to Roberts and 4,641,571 to Anderson et al. are known to Applicant. Each of these references teaches a fan mounted on an opening of a ventilation flue and designed to be activated for ventilation purposes. The present invention differs from the teachings of these patents as being specifically designed of a small, portable nature, battery powered and designed with means specifically intended to removably affix the device over the end of a rifle barrel.

SUMMARY OF THE INVENTION

The present invention relates to a rifle bore cooler. The present invention includes the following interrelated objects, aspects and features:

(A) In a first aspect of the present invention, it is intended that the inventive cooling device be made of a small lightweight construction, preferably having a plastic housing. The plastic housing contains a rotary fan which is operated by a small motor which is battery powered.

(B) The batteries are contained within a battery case formed as a part of the housing. In a further aspect, the housing has front and rear grills designed to allow air to flow through the housing when the fan is activated.

(C) In surrounding relation to one of these grills and including a portion mounted thereon, is a fastening device allowing releasable fastening of the inventive cooler on the end of a rifle barrel. The fastening device includes a plurality of fingers designed to flex about a portion of the rifle barrel adjacent its end and a central annulus designed to closely surround the end of the rifle barrel to maintain the inventive cooling device in releasable mounted position thereon.

As such, it is a first object of the present invention to provide an improved rifle bore cooler.

It is a further object of the present invention to provide such a device which is small, lightweight and battery powered.

It is a yet further object of the present invention to provide such a device which may easily be releasably attached to the end of a rifle barrel.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
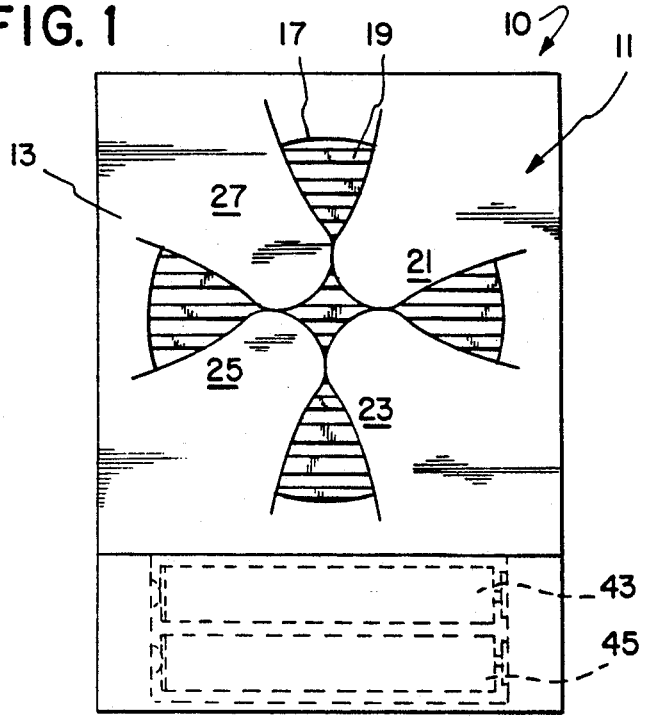
FIG. 1 shows a front view of the present invention.

With reference to the figures, the inventive rifle bore cooler is generally designated by the reference numeral 10 and includes a housing 11 preferably made of plastic and having a front wall 13 and a rear wall 15. As seen in FIG. 1, the front wall 13 has a circular opening 17 containing a grill 19 which may, if desired, be removably fastened within the opening 17 by any suitable means.

Figure 2:
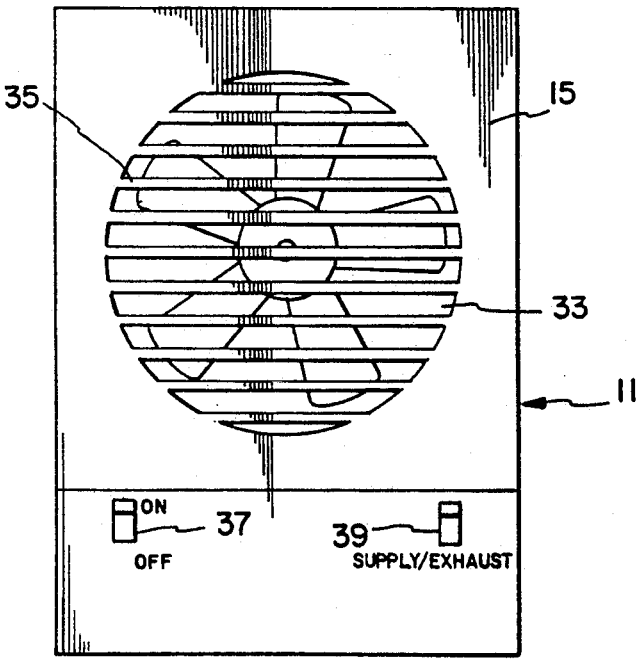
FIG. 2 shows a rear view of the present invention.

With particular reference to FIGS. 1 and 2, it is seen that the front wall 13 of the inventive device 10 has a plurality of fingers 21, 23, 25 and 27 extending radially inwardly toward the center of the grill 19. These fingers are made of flexible plastic and may selectively be flexed outwardly away from the front wall 13 of the housing 11. Additionally, with particular reference to FIG. 3, it is seen that an annulus 29 is centrally located on the grill 19 and is sized and configured to removably receive the end 8 of a rifle barrel 7 of a rifle 1. Of course, the annulus 29 may be removable from the grill 19 so that a particular annulus 29 may be installed on the grill 19 for each differently sized rifle barrel.

With reference to FIG. 2, it is seen that the rear wall 15 of the housing 11 also includes a generally circular opening 33 having a grill 35 either mounted therein or integrally formed with the housing 11. Also shown in FIG. 2 are two switches including an on-off switch 37 and a supply/exhaust switch 39. The switch 37 may be moved between on and off positions to activate and deactivate the fan device. The supply/exhaust switch 39 may be used to reverse the direction of rotation of the fan device.

Figure 3:
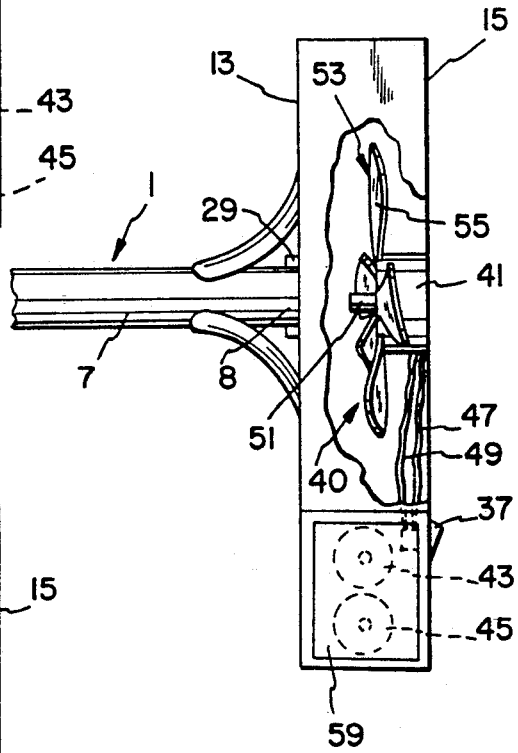
FIG. 3 shows a side view of the present invention, with certain portions thereof broken away to show detail.

With reference to FIG. 3, it is seen that the fan device is generally designated by the reference numeral 40 and includes a small motor 41 powered by batteries 43, 45 which are electrically connected to the motor 41 via electrical conductors 47, 49 and, of course, the on-off switch 37 and the supply/exhaust switch 39. The particular details of the electrical circuitry of the present invention are not shown in detail since they should be self-evident to one skilled in the art based upon the above description thereof.

The motor 41 has a drive shaft 51 which may be drivingly connected to a fan 53 having a plurality of blades 55. An access door 59 may be provided to allow access to the batteries 43, 45 to replace them when they are dead.

In the operation of the present invention, when a rifle such as the rifle 1 has been discharged and it is desired to cool the barrel 7 thereof, the device 10 may be installed over the end 8 of the barrel 7 of the rifle 1 with the annulus 29 surrounding the end 8 of the barrel and with the fingers 21, 23, 25, 27 flexed outwardly and engaging the walls of the barrel 7 as shown in FIG. 3. In this position, the on-off switch 37 may be switched to the "on" position to cause the fan 40 to be activated so that the fan blades 55 rotate rapidly. Through adjustment of the supply/exhaust switch 39, the user may selectively supply ambient air into the barrel 7 or may exhaust the atmosphere in the barrel therefrom.

As stated above, it is intended that the inventive device 10 be made of a small, portable, lightweight nature. As such, as stated above, the housing 11 may suitably be made of plastic. The fan portion 53 may also be made of lightweight plastic and it is intended that any and all of the components of the device 10 which may be made of lightweight materials such as plastic, aluminum, etc. are so constructed.

As such, an invention has been disclosed in terms of a preferred embodiment thereof which fulfills each and every one of the objects of the present invention and provides a new and useful rifle bore cooler of great novelty and utility. Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A firearm cooling device, comprising:

a) a housing having a front wall having a first opening with a first grill therein;

b) said housing having a rear wall having a second opening substantially aligned with said first opening and having a second grill therein;

c) a fan device contained within said housing and having a fan blade located between said grills, said fan device having an electric motor with a drive shaft coupled to said fan blade;

d) at least one battery contained within said housing and electrically connected to said motor;

e) switch means on said housing for activating and deactivating said motor; and f) attachment means for releasably attaching said device to an end of a barrel of a firearm.

2. The invention of claim 1, wherein said housing is made of plastic.

3. The invention of claim 1, wherein said at least one battery is contained within a battery chamber having an access door.

4. The invention of claim 1, further including a supply/exhaust switch on said housing which may be activated to reverse a direction of rotation of said fan blade.

5. The invention of claim 1, wherein said attachment means comprises a plurality of flexible fingers resiliently engageable with said barrel.

6. The invention of claim 5, wherein said fingers are attached to said housing adjacent said first opening.

7. The invention of claim 5, wherein said attachment means further comprises a central annulus mounted on said first grill and sized to receive said end of said barrel.

* * * * *